US005632288A

United States Patent [19]

Webb

[11] Patent Number: 5,632,288

[45] Date of Patent: May 27, 1997

[54] NAIL CLIPPINGS CATCHER

[76] Inventor: Jack D. Webb, 1025 Dove Run Rd. Suite 104, Lexington, Ky. 40502

[21] Appl. No.: 623,399

[22] Filed: Mar. 27, 1996

Related U.S. Application Data

[63] Continuation-in-part of Ser. No. 389,395, Feb. 16, 1995, abandoned.

[51] Int. Cl.[6] ..... B26B 17/00; A45D 29/02

[52] U.S. Cl. ..... 132/75.5; 132/75.6; 30/28

[58] Field of Search ..... 132/73.5, 75.4, 132/75.5, 75.6; 30/28, 27, 26

[56] References Cited

U.S. PATENT DOCUMENTS

| | | | |
|---|---|---|---|
| 3,180,025 | 4/1965 | Tsunemi | 132/75.4 |
| 4,341,015 | 7/1982 | Young | 30/28 |
| 4,550,496 | 11/1985 | Reinicke . | |
| 4,602,430 | 7/1986 | Allen, Jr. | 30/28 |
| 4,731,927 | 3/1988 | Wilson . | |
| 4,984,366 | 1/1991 | Powers . | |
| 5,090,427 | 2/1992 | Sherts . | |
| 5,131,146 | 7/1992 | Leininger . | |
| 5,150,521 | 9/1992 | Han | 132/75.5 |
| 5,195,544 | 3/1993 | Campagna . | |
| 5,261,160 | 11/1993 | Castagna . | |
| 5,423,124 | 6/1995 | Marrocco | 30/28 |

FOREIGN PATENT DOCUMENTS

| | | | |
|---|---|---|---|
| 2700674 | 7/1994 | France | 30/28 |

*Primary Examiner*—Todd E. Manahan
*Attorney, Agent, or Firm*—Richard C. Litman

[57] ABSTRACT

A catcher for nail clippings shaped to slip onto a standard nail clipper. The catcher is made of a resilient material having laterally projecting cells for receiving the clippings. The catcher is designed to allow convenient collection and disposal of the clippings while ensuring compatibility with commonly possessed nail clippers. Such a design incorporates a slit made substantially along the body of each of the projecting cells for quick and efficient disposal of the stored nail clippings. The catcher may optionally have an external abrasive surface useful for filing.

5 Claims, 3 Drawing Sheets

NAIL CLIPPINGS CATCHER

CROSS-REFERENCE TO RELATED APPLICATION

This application is a continuation-in-part of application Ser. No. 08/389,395 filed Feb. 16, 1995, now abandoned.

BACKGROUND OF THE INVENTION

1. Field of the Invention

The present invention relates generally to nail clippings receptacles and more particularly to a nail clippings receptacle having enhancements that improve the receptacle's functionality.

2. Description of the Prior Art

When trimming one's nails, the clippings have a tendency to spring away from the nail clipper in any number of unpredictably different directions. However, few people want to put up with the hassle of searching for stray nail clippings. For this reason there is a strongly perceived need for nail clippings receptacles for use with nail clippers. Many attempts to devise such receptacles have been made. Unfortunately, these prior attempts have numerous failings, both individually and when considered together.

U.S. Pat. No. 4,731,927, issued on Mar. 22, 1988, to Douglas B. Wilson, describes a nail clipper in which a flexible material disposed along the sides of the clipper is intended to prevent nail clippings from falling away from a nail clipper. However, the nail clippings which are kept from falling away from the nail clipper are unfortunately not ejected away from the clipper opening and into a storage receptacle. The nail clippings, accumulating at the clipper opening, therefore have the undesired effect of jamming the clipper's cutting means. This default results in mechanism failure. Furthermore, Wilson does not disclose any means for easy emptying of the nail clippings.

U.S. Pat. No. 4,984,366, issued on Jan. 15, 1991, to Robert B. Powers, describes a frusto-conical nail clipper cover that is intended to prevent discharge of nail clippings. Similar to Wilson, the nail clippings of the Powers clipper are not ejected away from the clipper opening and into a storage receptacle. This has the undesired effect of jamming the clipper's cutting means, resulting in mechanism failure. Furthermore, Powers also does disclose any means for easy emptying of the nail clippings.

U.S. Pat. No. 5,131,146, issued on Jul. 21, 1992, to Kent E. Leininger, describes a nail clippings receptacle comprised of a rear sleeve and a front shield. The shield and the sleeve are connected by a live hinge. This relatively complicated and expensive combination of hinge and sleeve prevents nail clippings from escaping from the nail clipper. However, the nail clippings of the Leininger clipper are not ejected away from the clipper opening and into storage. This has the undesired effect of jamming the clipper's cutting means, resulting in mechanism failure. Even though Leininger does disclose a means of emptying the nail clippings via manipulation of the live hinge, this procedure is cumbersome and awkward requiring two hands and dexterity.

U.S. Pat. No. 5,195,544, issued on Mar. 23, 1993, to Vince Campagna, describes a nail catcher case for use with a nail clipper. This case is intended to prevent nail clippings from escaping from the nail clipper. However, the nail clippings of the Campagna nail clipper are not ejected away from the clipper opening and into storage. As such, the nail clippings accumulate at the opening. This default results in mechanism failure due to a jamming effect of the nail clippings aggregated proximate the opening. Campagna also does not disclose any means for easy emptying of the nail clippings.

U.S. Pat. No. 5,261,160, issued on Nov. 16, 1993, to Leonardo F. Castagna, describes a nail clipper having an integral nail clippings catcher. The clipper has a three-positioned clipping lever, unnecessarily adding to the complication of clipping one's nails. However, Castagna also does not provide any place to store nail clippings. As such, nail clippings are not ejected away from the clipper's opening and into storage. This has the undesired effect of jamming the clipper's cutting means, resulting in mechanism failure. Furthermore, the Castagna device is relatively expensive to manufacture.

U.S. Pat. No. 4,550,496, issued on Nov. 5, 1985, to Raymond C. Reinicke, also describes a nail clipper having an integral nail clippings catcher. The clipper is securely positioned in the catcher by a wedging block and a rivet extending throughout the clipper, making the interchangeability of the catcher with another clipper virtually impossible, as well as time consuming and complicated. Even though Reinicke discloses a place to store nail clippings, the catcher is made of a rigid, transparent plastic material in order to apprise the user that the catcher should be emptied. This rigid plastic material does not provide an appropriately soft-textured grip resistant to slippage. The catcher is also quadrilaterally shaped. This shape is inconveniently big and bulky for the user. Furthermore, the only means of emptying the catcher is by shaking the nail clipper in order for the clippings to fall out an oversized opening surrounding the cutting members. This oversized opening tends to allow the nail clippings to escape the catcher while in use. In addition, this means of emptying is inconvenient as well as time-consuming for the user.

Another patent which may be relevant even though it does not refer to catchers, or even nail clippers, is U.S. Pat. No. 5,090,427, issued on Feb. 25, 1992, to Charles Sherts. Sherts discloses a finger groomer attachment for a writing instrument which incorporates an abrasive strip for shaping of the fingernails. The abrasive strip is integrated onto the front of the writing instrument and more particularly to the surface of a clip used to attach the writing instrument to a shirt pocket. After use, the abrasive strip must be inconveniently cleaned before it is to be placed for all to see on the front of the shirt pocket.

None of the above inventions and patents, taken either singly or in combination, is seen to describe the instant invention as claimed. Thus a nail clippings catcher solving the aforementioned problems is desired.

SUMMARY OF THE INVENTION

In the present invention, a catcher for clipped finger nails is dimensioned and configured to slip onto a standard nail clipper. The catcher is completely interchangeable with the standard nail clipper in an extremely efficient manner. No wedges or rivets need be used since the catcher's design provides for a detachably secure fit of the catcher around the clipper. This design allows the catcher to receivingly capture and substantially enclose the clipper whereby the clippings are not only prohibited from accidently falling out of the clipper, but they are also stored within the catcher itself, thereby allowing the nail-clipping process to continue unimpeded by any of the clippings. Furthermore, this design incorporates a resilient polymeric material which has a dual function. Firstly, the material is effective in providing the user with a grip onto the clipper without concern of slippage. Secondly, the material permits the user to temporarily place into compression two laterally projecting holding cells of the catcher used to receive and store the nail clippings, whereby each of the cells temporarily open outward along a slit formed along the cell bodies. This temporary opening allows the stored clippings to conveniently escape from the catcher with ease and efficiency. Additionally, the present invention provides for a nail filing mechanism suitably placed on the bottom surface of the catcher where it can be used before or directly after trimming one's nails.

Accordingly, it is a principal object of the invention to allow convenient retention of nail clippings during use of a nail clipper, so as to make disposal of nail clippings easier.

It is another object of the invention to ensure that nail clippings retained during use of a nail clipper do not interfere with the nail-clipping process.

It is still another object of the invention to allow for a quick and efficient means of disposing nail clippings retained during use of a nail clipper.

Still another object of the invention is to provide an abrasive surface on a nail clippings retainer apparatus for the purpose of filing one's nails without removing the apparatus from the clipper and without use of a separate filing apparatus.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
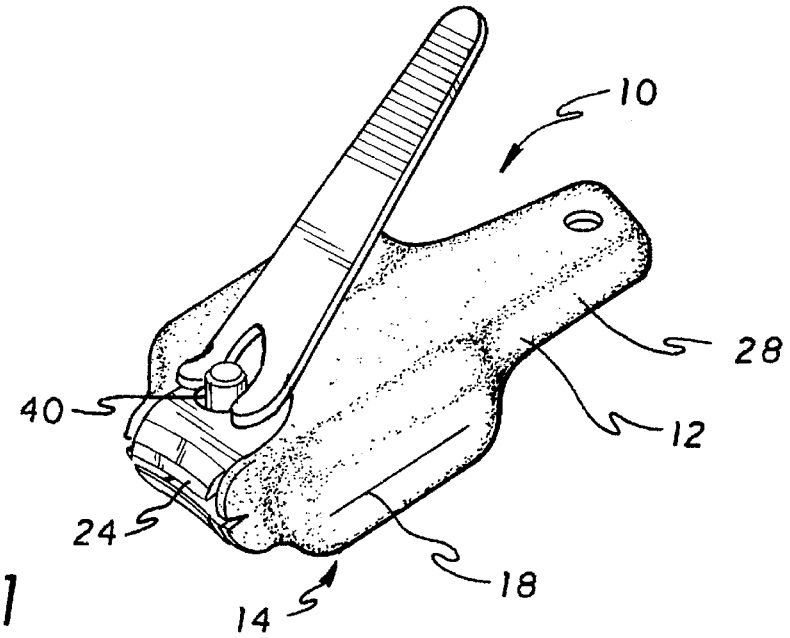
FIG. 1 is an environmental, perspective view of the nail clippings catcher according to the present invention showing the catcher in place on a nail clipper.
Figure 2:
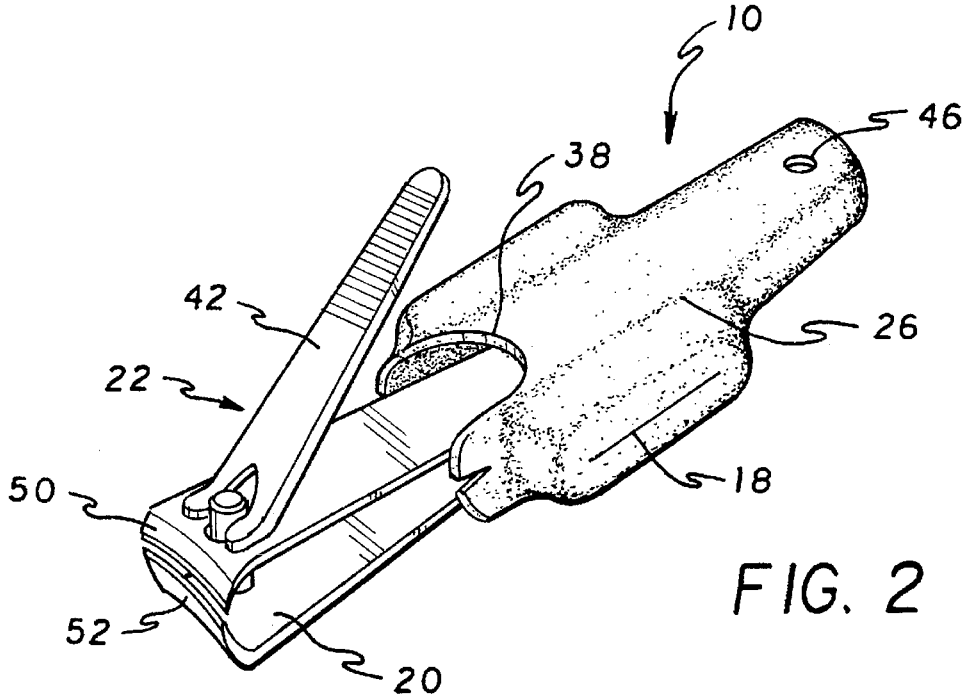
FIG. 2 is an environmental, perspective view of the nail clippings catcher according to the present invention showing the catcher partly removed from a nail clipper.
Figure 3:
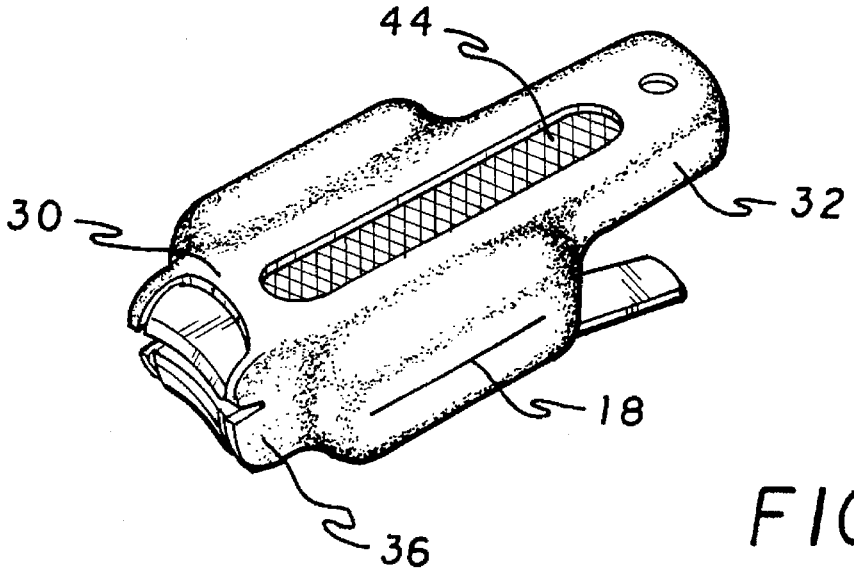
FIG. 3 is a perspective view of a bottom surface of the nail clippings catcher according to the present invention showing an abrasive filing surface.
Figure 4:
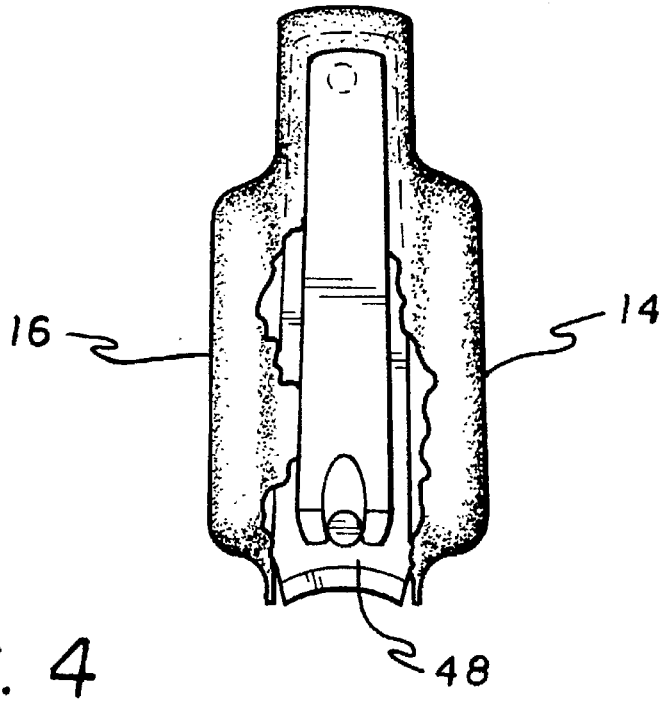
FIG. 4 is a top cutaway view of the nail clippings catcher according to the present invention showing the nail-clippings-storing projections of the catcher.
Figure 5:
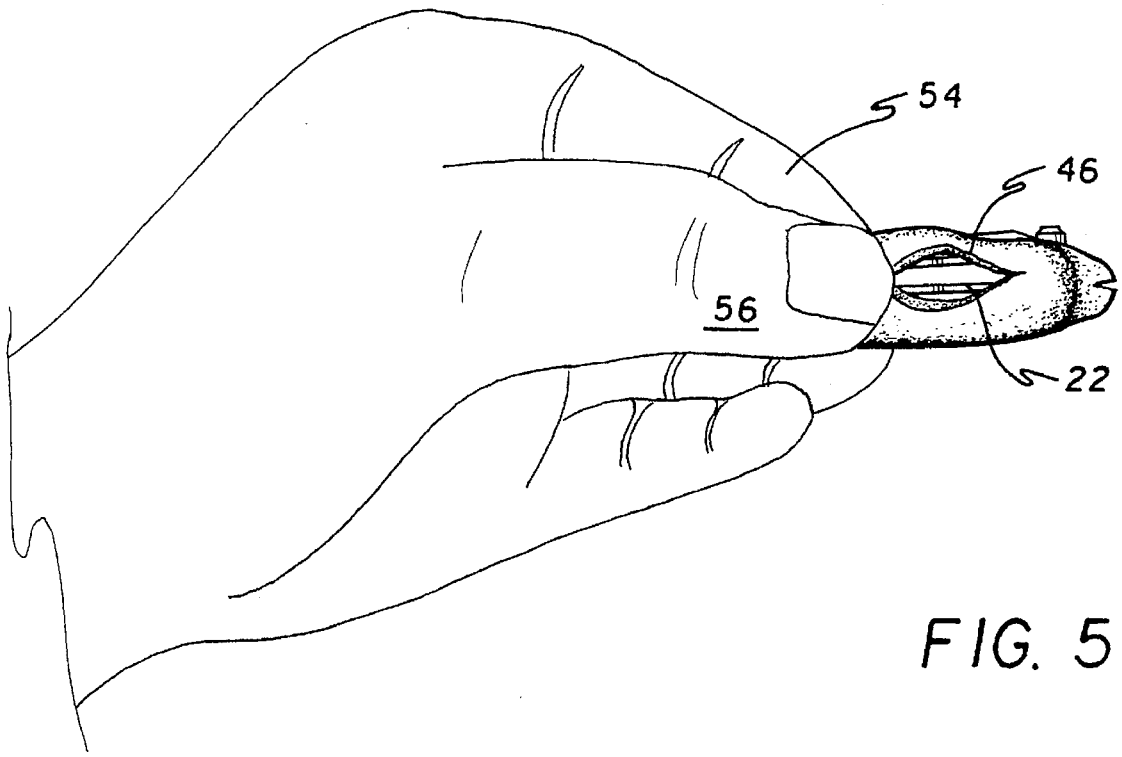
FIG. 5 is a side view of the nail clippings catcher according to the present invention showing the temporary openings made in the nail-clippings-storing projections of the catcher when a user temporarily exhibits pressure onto the catcher.

FIGS. 1–5 show a nail clippings catcher 10 embodying the present invention comprising a clipper-receiving receptacle 12 with laterally disposed holding cells 14, 16. These holding cells 14, 16 have sufficient volume to hold a plurality of nail clippings. Without such holding cells 14, 16, a catcher would cause clipped nails to accumulate within a clipping mechanism 20 of a clipper 22, thereby rendering it non-functional. Alternately, a catcher without holding cells 14, 16 would cause clipped nails to fall out through an opening 24 in the clipper 22 through which they entered, thereby making a catcher unable to complete its catching function.

The clipper-receiving receptacle 12 has four surface members 26, 28, 30, 32, joined to define a closed, narrow end 34 of the receptacle 12 and an open, wide end 36 of the receptacle 12. The narrow end 34 has a bore 46 running through the surfaces 26, 30 and throughout the clipper 22, thereby permitting the user of the clipper 22 to place a chain (not shown) therethrough such that the clipper 22 and its nail clipping catcher 10 may be conveniently carried on a key chain or the like. The holding cells 14, 16 are closer to the wide end 36 than to the narrow end 34. One of the surface members 26 has a notch 38 at the open, wide end 36, into which a pivot joint 40 of a pressing lever 42 on a standard nail clipper 22 may be slidably inserted. Two of the surface members 28 and 32 each have a slit 18 substantially along holding cells 14, 16, respectively. The material comprising the catcher is made of a resilient polymeric material. The closed nature of the narrow end 34 in combination with the resiliency of the material comprising the receptacle 12 ensures the user that clipper 18 is detachably secured within the catcher 10.

Optionally, on surface member 26 or preferably an opposite surface member 30, an abrasive surface 44 may be disposed, externally relative to receptacle 12. This abrasive surface 44 can be used for filing clipped or unclipped nails. Also as an option, external surfaces of surface members 26, 28, 30, 32 of the catcher 10 can be pigmented so as to coordinate aesthetically with related articles, such as other toiletry articles or clipper storing articles.

In use of the present invention, a user would first place the catcher 10 according to the present invention on a standard nail clipper 22, while the standard clipper 22 is oriented so that its pressing lever 42 is in position for use. An end 48 of the clipper 22 is then fully inserted into the wide end 36 of the clipper-receiving receptacle 12 of the catcher 10, so that the pivot joint 40 of the pressing lever 42 is proximate to notch 38. In this combined configuration of catcher 10 and clipper 22, the catcher 10 is ready for catching nail clippings.

The user at this point inserts a nail to be clipped into the clipping blades 50, 52 of the standard nail clipper 22. The user then presses the pressing lever 42 of the clipper 22 and effects a clipping of the inserted nail. By force of the clipping mechanism 20 of the clipper 22, this nail clipping is ejected and lodged within the catcher 10. Because of the holding cells 14, 16, a clipping so ejected will proceed immediately to one of the holding cells 14, 16 for storage. Once in a holding cell 14, 16, a nail clipping will not obstruct the clipping mechanism 20 of a clipper. Moreover, a clipping in a holding cell 14, 16 will not fall out of the catcher 10 or fall away from the clipper 22 until the user so desires to discharge the stored clippings. For these reasons, a catcher 10 with holding cells 14, 16 is a substantial improvement over a catcher without holding cells 14, 16. In fact, without holding cells 14, 16, a catcher is practically useless.

Once finished clipping nails, a user can take steps to efficiently and quickly discharge the stored clippings from within the holding cells 14, 16, either immediately or at leisure. Conveniently, the clippings are sanitarily contained within the holding cells 14, 16 of the catcher 10 until removal is desired. The user discharges the clippings by making a pinching motion with fingers 54, 56, compressing together the holding cells 14, 16 to such an extent that a temporary opening 24 is formed. As soon as the opening 24 is formed, the clippings stored in the holding cells 14, 16 of the catcher will easily fall out. In such a manner, the user may conveniently dispose of the clippings into an appropriate disposal receptacle not part of the invention.

It is to be understood that the present invention is not limited to the embodiments described above, but encompasses any and all embodiments within the scope of the following claims.

I claim:

1. A nail clippings catcher for use with a nail clipper to releasably capture a plurality of nail clippings, said catcher comprising:

a resilient receptacle having a closed narrow end and an open wide end, said receptacle having first and second lateral hollow projections proximate said open wide end, each of said projections having a slit extending substantially therealong.

2. The catcher according to claim 1, said receptacle having an external abrasive surface.

3. A nail clippings catcher in combination with a nail clipper for releasably capturing a plurality of nail clippings, said catcher comprising:

a receptacle having a closed narrow end and an open wide end;

a notch proximate said open wide end, said notch being dimensioned and configured to receive a pivot joint of a pressing lever of said nail clipper;

first and second holding cells projecting outward from said receptacle, said cells being dimensioned and configured to hold nail clippings without causing the nail clippings to interfere with operation of said nail clipper; and a slit cut substantially along each of said holding cells for releasing the nail clippings held in said holding cells.

4. The catcher according to claim 3, said receptacle being made of a resilient material.

5. The catcher according to claim 3, said receptacle having an abrasive external surface.

* * * * *